US010774424B2

(12) United States Patent
Atthoff et al.

(10) Patent No.: US 10,774,424 B2
(45) Date of Patent: Sep. 15, 2020

(54) METALIZATION OF SURFACES

(71) Applicant: Cuptronic Technology Ltd., Limassol (CY)

(72) Inventors: Björn Atthoff, Uppsala (SE); Sven Göthe, Bromma (SE)

(73) Assignee: CUPTRONIC TECHNOLOGY LTD., Limassol (CY)

( * ) Notice: Subject to any disclaimer, the term of this patent is extended or adjusted under 35 U.S.C. 154(b) by 0 days.

(21) Appl. No.: 15/336,839

(22) Filed: Oct. 28, 2016

(65) Prior Publication Data

US 2017/0044670 A1 Feb. 16, 2017

Related U.S. Application Data

(63) Continuation of application No. PCT/EP2015/059144, filed on Apr. 28, 2015.

(30) Foreign Application Priority Data

Apr. 28, 2014 (SE) ..... 1450500

(51) Int. Cl.
*C23C 18/16* (2006.01)
*C23C 18/20* (2006.01)
*C23C 18/30* (2006.01)

(52) U.S. Cl.
CPC ..... *C23C 18/1612* (2013.01); *C23C 18/165* (2013.01); *C23C 18/1607* (2013.01); *C23C 18/1639* (2013.01); *C23C 18/1641* (2013.01); *C23C 18/204* (2013.01); *C23C 18/2033* (2013.01); *C23C 18/2086* (2013.01); *C23C 18/30* (2013.01); *C23C 18/208* (2013.01)

(58) Field of Classification Search
CPC ..... C23C 18/1612; C23C 18/1607; C23C 18/1639; C23C 18/1641; C23C 18/165; C23C 18/2033; C23C 18/204; C23C 18/2086; C23C 18/30; C23C 18/208
See application file for complete search history.

(56) References Cited

U.S. PATENT DOCUMENTS

| | | | | |
|---|---|---|---|---|
| 2003/0078315 A1 * | 4/2003 | Bradford | ..... | C08G 18/4208 522/126 |
| 2010/0071828 A1 | 3/2010 | Sato | | |
| 2011/0104454 A1 | 5/2011 | Kawano et al. | | |

FOREIGN PATENT DOCUMENTS

| | | | | |
|---|---|---|---|---|
| EP | 1 580 595 A2 | 9/2005 | | |
| EP | 2 087 942 A1 | 8/2009 | | |
| JP | 2011-94192 A | 5/2011 | | |
| WO | WO2011-030089 * | 3/2011 | ..... | C09D 11/101 |
| WO | WO-2012066018 A2 * | 5/2012 | ..... | B05D 1/62 |
| WO | 2014/086844 | 6/2014 | | |

OTHER PUBLICATIONS

Official Action dated Sep. 18, 2017 from corresponding European Application No. 15718500.0.
Official Office Action dated Mar. 3, 2019 from corresponding Japanese Application No. 2016-565020 with English Translation.

* cited by examiner

*Primary Examiner* — Robert S Walters, Jr.
(74) *Attorney, Agent, or Firm* — Porter Wright Morris & Arthur LLP

(57) ABSTRACT

A method of metallizing substrate with abstractable hydrogen atoms and/or unsaturations on the surface, comprising the steps: a) contacting the substrate with a polymerizable unit, at least one initiator which can be activated by both heat and actinic radiation, and optionally at least one solvent, b) inducing a polymerization reaction c) depositing a second metal on an already applied first metal to obtain a metal coating. A first metal is added as ions and/or small metal particles during the process. Ions are reduced to the first metal. Advantages include that the adhesion is improved, the process time is shortened, blisters in the metal coating are avoided, the polymer layer below the metal coating becomes less prone to swelling for instance in contact with water.

28 Claims, No Drawings

METALIZATION OF SURFACES

This application is a continuation of the International Application No. PCT/EP2015/059144 filed on 28 Apr. 2015, which claims priority to the Swedish Application No. SE-1450500-2 filed 28 Apr. 2014, the entire contents of which are hereby incorporated by reference.

TECHNICAL FIELD

The present invention relates generally to a method of applying a metal on a substrate surface, using a polymerization initiator activated by both heat and actinic radiation.

BACKGROUND

In the prior art many different methods of applying a metal on a substrate surface are described. Metallization of objects including polymeric objects are known from for instance WO 98/34446, WO 2007/116056, WO 2007/116057, and WO 2012/066018. One known method comprises covalent attachment of polymers to a surface with adsorption of for instance ions to charges on the polymers, where the ions are reduced to metal. Further metal can then be applied.

US 2010/0167045 discloses a reactive mixture for coating moldings by means of reaction injection molding and comprising at least one photo-initiator and at least one thermal initiator.

Although metallization of surfaces is accomplished today, it is desirable to further improve the adhesion of the metal to the substrate.

It is also desirable to decrease the processing time for the metallization process in an industrial scale.

In some cases there are problems with blisters in the metal coating.

In some cases where there are problems with the boundary between a coated part of a surface and an uncoated part of the surface. The boundary does not always become sharp enough.

In general it is also desirable to reduce the cost of a metallization process.

SUMMARY

It is an object of the present invention to obviate at least some of the problems in the prior art and provide an improved metallized substrate as well as an improved method of metallizing a substrate.

In a first aspect there is provided a method for application of a metal on a substrate, said method comprising the steps:

a) providing a substrate, wherein at least a part of the surface of the substrate comprises at least one selected from the group consisting of an abstractable hydrogen atom and an unsaturation, b) contacting at least a part of the surface of the substrate with at least one polymerizable unit, at least one initiator, and optionally at least one solvent, wherein said at least one polymerizable unit is able to undergo a chemical reaction to form a polymer comprising at least one charged group, wherein said at least one initiator has the ability to be activated by both heat and actinic radiation, c) inducing a polymerization reaction by exposure to both heat and actinic radiation adapted to said at least one initiator to form polymers on at least a part of the surface of said substrate, said polymers comprising at least one charged group, and said polymers forming covalent bonds after reaction with at least one selected from an abstractable hydrogen atom and an unsaturation on said substrate, d) depositing a second metal on an already applied first metal to obtain a metal coating, wherein at least one of the following additions is made to apply the first metal on the polymers at least once at a point selected from: before step b), between steps b) and c), and between steps c) and d):

i) addition of ions of at least one first metal and reducing said ions to metal, wherein a) said ions have the opposite sign of the charge compared to said at least one charged group on said polymer, or b) wherein said ions have the same sign of the charge compared to said at least one charged group on said polymer and wherein at least one chemical compound is added and at least partly adsorbed to the polymer comprising at least one charged group, said at least one chemical compound comprising at least one charge with a sign opposite compared to said ions, ii) addition of metal particles of at least one first metal, wherein said particles have a diameter in the range 1-1000 nm.

Further aspects and embodiments are detailed in the description and in the dependent claims.

Advantages of the invention include that the adhesion of the metal coating is improved. After extensive research it has turned out that initiators with a dual curing mechanism with both heat and actinic radiation gives more efficient covalent bonding of the polymer to the substrate via the abstractable hydrogen atoms and/or unsaturations on the substrate surface. With the dual initiation mechanism it has turned out that more polymers are covalently attached to the surface. The dual curing mechanism gives better relaxation before the final curing and this give less built in tensions in the finalized coating, this also gives better adhesion.

Also the propagation of the polymerization reaction is improved when using the dual curing mechanism with both heat and actinic radiation.

Another advantage is that the method gives a quicker polymerization process. This is an advantage in particular for large scale manufacturing.

A further advantage is that blisters in the metal coating are reduced or even eliminated.

A further advantage is that problems arising when the polymer layer under the metal coating swells are reduced or even eliminated. Without wishing to be bound by any particular scientific theory this is attributed to that the dual activated initiators give a more branched or even cross linked polymer layer which is less prone to swelling for instance in contact with water.

Another advantage is that the required concentration of ions and/or metal particles of the first metal is lower compared to the process where dual activated initiators are not used. If for instance palladium ions are used as the first metal, the lower required concentration of palladium ions give a less expensive process, since palladium is an expensive metal.

DETAILED DESCRIPTION

Before the invention is disclosed and described in detail, it is to be understood that this invention is not limited to particular compounds, configurations, method steps, substrates, and materials disclosed herein as such compounds, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms "a", "an" and "the" include plural referents unless the context clearly dictates otherwise.

If nothing else is defined, any terms and scientific terminology used herein are intended to have the meanings commonly understood by those of skill in the art to which this invention pertains.

"Abstractable hydrogen" as used herein denotes a hydrogen atom which can be removed in a chemical reaction when a covalent bond is formed with another chemical compound. Examples of abstractable hydrogen atoms include but are not limited to hydrogen atoms covalently bound to O, C, N, and S.

"Actinic radiation" as used herein denotes electromagnetic radiation with the ability to cause a photochemical reaction. Examples include but are not limited to visible light, UV-light, IR-light all with the ability to cause a photochemical reaction and/or heat induced reaction.

"Polymerizable unit" as used herein denotes a chemical compound which is able to participate in a chemical reaction which yields a polymer.

"Unsaturation" as used herein in connection with an organic chemical compound to denote rings (count as one degree of unsaturation), double bonds (count as one degree of unsaturation), and triple bonds (count as two degrees of unsaturation).

In a first aspect there is provided a method for application of a metal on a substrate, said method comprising the steps:

a) providing a substrate, wherein at least a part of the surface of the substrate comprises at least one selected from the group consisting of an abstractable hydrogen atom and an unsaturation, b) contacting at least a part of the surface of the substrate with at least one polymerizable unit, at least one initiator, and optionally at least one solvent, wherein said at least one polymerizable unit is able to undergo a chemical reaction to form a polymer comprising at least one charged group, wherein said at least one initiator has the ability to be activated by both heat and actinic radiation, c) inducing a polymerization reaction by exposure to both heat and actinic radiation adapted to said at least one initiator to form polymers on at least a part of the surface of said substrate, said polymers comprising at least one charged group, and said polymers forming covalent bonds after reaction with at least one selected from an abstractable hydrogen atom and an unsaturation on said substrate, d) depositing a second metal on an already applied first metal to obtain a metal coating, wherein at least one of the following additions is made to apply the first metal on the polymers at least once at a point selected from: before step b), between steps b) and c), and between steps c) and d):

i) addition of ions of at least one first metal and reducing said ions to metal, wherein a) said ions have the opposite sign of the charge compared to said at least one charged group on said polymer, or b) wherein said ions have the same sign of the charge compared to said at least one charged group on said polymer and wherein at least one chemical compound is added and at least partly adsorbed to the polymer comprising at least one charged group, said at least one chemical compound comprising at least one charge with a sign opposite compared to said ions, ii) addition of metal particles of at least one first metal, wherein said particles have a diameter in the range 1-1000 nm.

The polymerizable units react with the initiator(s) and at least a part of the resulting polymer chains will be covalently bound to the surface by reaction with the abstractable hydrogens and/or unsaturations on the substrate surface. When the initiator(s) are activated radicals are formed on the surface of the substrate and they function as anchor points for the growing polymer chains so that a covalent bond is formed. At the same time in some cases cross linking reactions also take place so that the resulting polymers become cross linked. At the same time in some embodiments the polymerization reaction occurs so that the polymer chains become branched. The branched and/or cross linked polymers give a higher mechanical strength so that the thin polymer layer is less prone to swell at interaction with water etc.

On the polymers with the charged groups a first metal is adsorbed. This is made either by adsorption of oppositely charged metal ions or by adsorption of small metal particles (1-1000 nm). Alternatively charged compounds can be adsorbed to the polymers so that metal ions can be adsorbed to the oppositely charged compounds adsorbed to the polymers. In case of metal ions they are reduced to metal. The addition of the first metal takes place before step b), between steps b) and c) or between steps c) and d). As an alternative the addition of the first metal takes place at several of these points. Both ions and metal particles can be added during the same process, either simultaneously or at different points. For instance when metal ions and/or metal particles are added before step a) it is conceived that the metal ions are still in the mixture and can act later in the method. The metal ions are reduced to metal by using methods known to a skilled person. It is understood that the particles adhere to the polymers due to attractive forces, including electrostatic forces.

The expression a polymer comprising at least one charged group should be interpreted so that the polymer comprises at least one charged group in aqueous solution, i.e. in contact with water, either at pH around 7, above 7, or below 7.

When the first metal has been adsorbed on the polymers and reduced to metal (in case of ions) the second metal is subsequently applied on the surface. The application of the second metal is facilitated by the existing first metal.

Optionally a third metal is applied on the second metal. Optionally one or more layers of metal are applied on top of the third metal.

In one embodiment the metal particles which may be added as alternative ii) in claim 1 have diameters in the range 2-500 nm, alternatively 5-500 nm. Particles with an irregular shape are also encompassed. Many particles with different diameters are encompassed and the diameter of all particles should be within the range. A particle with an irregular shape may not have a well-defined diameter like a spherical particle. In case of a particle where the diameter is not directly and unambiguously possible to determine the diameter is defined as the largest dimension of the particle in any direction.

In one embodiment a further metal is applied to the existing metal on the surface of the substrate, said further metal can be the same as the mentioned second metal or a third metal. When the second metal has been deposited on the substrate a third metal can thus be deposited on the second metal. In one non limiting example palladium ions are deposited and reduced as the first metal, subsequently copper is deposited on the reduced palladium ions and silver is deposited on the copper.

The initiator is in one embodiment a mixture of a compound that can act as an initiator and an energy transfer compound which can transfer energy to the compound acting as initiator. Such mixtures are also called "initiator". Instead of using actinic radiation with a certain wavelength adapted to the compound that can act as an initiator one can add an energy transfer compound that absorbs the energy in the actinic radiation and transfers it to the compound that can act as an initiator. Both compound thus act together as an initiator.

It is understood that the substrate provided in step a) is not yet coated with metal. When the metal coating of the substrate is finished it is a metallized substrate. The substrate provided in step a) can also be referred to as the bare substrate alternatively uncoated substrate, alternatively unmetallized substrate.

At least a part of the surface of the substrate comprises at least one selected from the group consisting of an abstractable hydrogen atom and an unsaturation. It is understood that the unmetallized substrate in one embodiment comprises a material comprising at least one selected from the group consisting of an abstractable hydrogen atom and an unsaturation. In an alternative embodiment the unmetallized substrate is treated so that its surface comprises at least one selected from the group consisting of an abstractable hydrogen atom and an unsaturation. In one embodiment such a surface treatment comprises covalent binding of at least one compound comprising at least one selected from an abstractable hydrogen and an unsaturation. In one embodiment such a surface treatment comprises adsorption of at least one compound comprising at least one selected from an abstractable hydrogen and an unsaturation. In one embodiment such a surface treatment is a combination of covalent binding and adsorption to the surface.

By using the approach with surface modification to obtain a surface comprising at least one selected from an abstractable hydrogen and an unsaturation, it is possible to metallize materials where the bulk of the material does not comprise any abstractable hydrogens or unsaturations. Examples of such materials include but are not limited to glass, oxides, and ceramic materials including oxides of aluminum, beryllium, cerium, zirconium. Further examples of materials include but are not limited to carbides, borides, nitrides and silicides.

In one embodiment the substrate comprises at least one polymer.

In one alternative the substrate is made of glass, where the glass has been treated so that its surface at least partially comprises at least one selected from an abstractable hydrogen and an unsaturation.

The solvent is optional. In one embodiment the optional solvent is selected from the group consisting of methanol, ethanol, acetone, ethylene glycol, isopropyl alcohol, and ethyl acetate. In an alternative embodiment the optional solvent is selected from the group consisting of methanol, and ethanol.

In one embodiment the at least one initiator forms one phase together with the at least one polymerizable unit and the optional at least one solvent. This facilitates the application of the various compounds onto the substrate and the application can be performed in one step, which saves time and costs.

In one embodiment the polymerizable unit is a monomer. In an alternative embodiment the polymerizable unit is an oligomer. The polymerizable unit can undergo a chemical reaction and form a polymer. If the polymerizable unit is a monomer it can undergo a polymerization reaction to form a polymer. Oligomers are compounds formed by a polymerisation reaction of a few monomers. The oligomers can in turn undergo a reaction to form a polymer. In one embodiment the at least one polymerizable unit is at least one selected from a polymerizable monomer and a polymerizable oligomer.

In one embodiment the polymerizable unit is at least one organic acid.

In one embodiment the polymerizable unit is at least one selected from the group consisting of methacrylic acid, acrylic acid, and maleic acid. In one embodiment the polymerizable unit is at least one selected from the group consisting of methacrylic acid, ethyl acrylate, 2-hydroxyethyl acrylate and acrylic acid.

In one embodiment the polymerizable unit is at least one selected from the group consisting of methacrylic acid, and acrylic acid.

The polymerization reaction is induced by actinic radiation and heat. Heat is applied by at least one selected from IR-irradiation, application of hot air/hot gas, and bringing the substrate in contact with a heated surface.

In one embodiment the heat and actinic radiation are applied simultaneously. In one embodiment one source of both heat and actinic radiation is utilized to apply heat and actinic radiation simultaneously. One non limiting example is a lamp irradiating both IR-radiation and light. In an alternative embodiment the heat and actinic radiation are applied separate. Thereby a larger part of the wavelength spectrum can be utilized, at least for some sources of electromagnetic radiation.

In an alternative embodiment one curing mechanism is first activated and then the other mechanism is activated. For instance actinic radiation is first used and subsequently heat is used.

When the curing is performed with two steps there is still some mobility in the system before the final curing. This is an advantage because there will be less tensions in the system after the final curing.

By using the dual curing mechanism at least some complex geometries can be coated. In a complex 3D-body there may be areas where light (actinic raciation) cannot access. If such areas are not too large the lower level of light or absence of light can to some extent be compensated by curing with heat, so that at least some curing occurs even in those areas.

Initiators affected by both actinic radiation and heat are utilized. Examples of such initiators include but are not limited to alpha-hydroxyketone, phenylglycolate, acylphospine oxide, alpha aminoketones, benzildimethylketal, and oxime esters. Also peroxides and azo compounds are possible to use as initiators, activated primarily by heat and to some extent also by actinic radiation.

In one embodiment the initiators above are mixed with a further type of initiator. Examples of such further initiators include but are not limited to at least one photoinitator selected from the group consisting of antraquinone, thioxanthone, isopropyl thioxanthone, xanthone, benzophenone, and fluorenone.

Examples of alpha-hydroxyketones include but are not limited to: 1-hydroxy-cyclohexyl-phenyl-ketone, 2-hydroxy-2-methyl-1-phenyl-1-propanone, 2-hydroxy-1-{4-[4-(2-hydroxy-2-methyl-propionyl)-benzyl]-phenyl}-2-methylpropan-1-one, and 2-hydroxy-1-[4-(2-hydroxyethoxy) phenyl]-2-methyl-1-propanone.

Examples of phenylglycolates include but are not limited to: oxy-phenyl-acetic acid 2-[2-oxo-2-phenyl-acetoxy-ethoxy]-ethyl ester, oxy-phenyl-acetic acid 2-[2-hydroxy-ethoxy]-ethyl ester, and phenyl glyoxylic acid methyl ester.

Examples of acylphosphine oxides include but are not limited to 2,4,6-trimethylbenzoyl-diphenylphosphine oxide, 2,4,6-trimethylbenzoyl-diphenyl phosphinate, and bis(2,4,6-trimethylbenzoyl)-phenylphosphineoxide.

Examples of alpha-aminoketones include but are not limited to 2-methyl-1 [4-(methylthio)phenyl]-2-morpholinopropan-1-one, 2-benzyl-2-dimethylamino-1-(4-morpholinophenyl)-butanone-1, and 2-dimethylamino-2-(4-methyl-benzyl)-1-(4-morpholin-4-yl-phenyl)-butan-1-one.

A non limiting example of a benzildimethyl ketal is 2,2-dimethoxy-1,2-diphenylethan-1-one.

Examples of peroxide include but are not limited to ketone peroxides, diacyl peroxides, dialkyl peroxides (dicumyl peroxide), peroxyesters, peroxyketals, hydroperoxides, peroxydicarbonates and peroxymonocarbonates.

Examples of peroxide include but are not limited to ketone peroxides, diacyl peroxides, dialkyl peroxides (dicumyl peroxide), peroxyesters, peroxyketals, hydroperoxides, peroxydicarbonates and peroxymonocarbonates.

Examples of azo compounds include but are not limited to 2,2-azo di(isobutyronitrile) (AIBN)

The fact that the initiator is activated by both heat and actinic radiation simultaneously has a number of advantages. The adhesion becomes better, since the initiation of the reaction is more efficient there will be a more efficient covalent bonding of the polymer to the substrate surface which in turn will give better adhesion. A more efficient initiation can also give more crosslinks in the polymers and/or more branched polymers which in turn also will give an improved adhesion. It has also turned out that lower concentrations of the first metal (for instance palladium) is required if an initiator with dual activation mechanism (heat and actinic radiation) is utilized.

Not only is the initiation positively affected by the initiator activated simultaneously by both heat and actinic radiation. Also the propagation of the polymerization reaction is positively influenced when using both heat and actinic radiation to initiate the reaction.

In one embodiment the substrate is treated with at least one selected from plasma, corona, and flame treatment before step b). This treatment can improve the wettability of the surface.

In one embodiment the substrate is washed before step d).

In one embodiment the second metal is at least one selected from the group consisting of copper, silver, nickel, and gold. In one embodiment the first metal is palladium.

It is understood that also further layers of metal can be applied on the metal coated surface. Further layer(s) of metal can be applied using known techniques. It is well known how to apply further metal on an existing layer of metal.

In one embodiment at least one solvent is present in step b) and the at least one solvent is at least partially evaporated between step b) and step c). Thus the polymerization reaction in step c) can be carried out when the mixture on the surface is dried or if a part of the solvent has evaporated. This has the advantage that the viscosity increases so that the mixture more easily stays on the surface during activation of the initiator. Further it is possible to perform steps a) and b) and then wait a period of time before step c) is carried out. The substrate can be stored or transported before step c) is carried out in this embodiment.

The impact of oxygen in the process can be minimized through optimizing the thickness of the layer or use of protective gases.

The wavelength of the UV source, laser or light used for irradiation should match the absorption of spectra of the initiator, if such an initiator is used. In one embodiment initiators activated by both actinic radiation and heat are used.

The heat, i.e. the temperature should be adapted to the initiator used. When selecting temperature also the substrate material and the polymer has to be considered.

The initiation of the polymerization reaction is made with heat and actinic radiation. Heat and actinic radiation can be applied sequentially or simultaneously. For instance actinic radiation can be applied first and heat can be applied afterwards. In one embodiment the polymerization is induced by exposure to heat adapted to said at least one initiator and subsequently exposure to actinic radiation adapted to said at least one initiator. In an alternative embodiment the polymerization is induced by exposure to actinic radiation adapted to said at least one initiator and subsequently exposure to heat adapted to said at least one initiator. In yet another embodiment the polymerization is induced by exposure to actinic radiation adapted to said at least one initiator and exposure to heat adapted to said at least one initiator, simultaneously.

In one embodiment the polymerization reaction is induced by irradiation with a UV light source that matches the wavelength sensitivity of the photo initiator.

The polymerizable unit is in one embodiment selected from various polymerizable units having a carboxyl functional group. Thus the polymerizable unit will become a carboxyl group as a charged group.

The grafting process step has been verified with energies down to 50 mJ/cm' to activate the initiator.

In one embodiment the second metal is at least one selected from the group consisting of copper, silver, and gold. In one embodiment the first metal is selected from nickel and palladium.

In a second aspect there is provided a metallized substrate manufactured according to the method described above.

Other features and uses of the invention and their associated advantages will be evident to a person skilled in the art upon reading the description and the examples.

It is to be understood that this invention is not limited to the particular embodiments shown here. The following examples are provided for illustrative purposes and are not intended to limit the scope of the invention since the scope of the present invention is limited only by the appended claims and equivalents.

EXAMPLES

Example 1

A grafting solution consisting of methacrylic acid (25 weight-%), 1-hydroxy-cyclohexyl-phenyl-ketone (1.5 weight-%) and methanol was prepared.

The solution was sprayed by an air spray gun to a panel made of PA 6/PA 66 polymer filled with carbon black and glass fiber (50 weight-%) of 8×8 cm size. The dry thickness was varied from 10 μm to 50 μm. Drying time (sample could be handle without damaging the dry grafting layer) varied from 10 seconds to 40 seconds at room temperature dependent on wet film thickness.

The panels were irradiated with a 2W laser emitting light at 355 nm.

The samples were irradiated with an energy of 800 mJ/cm$^2$. The spot diameter was 240 μm. The irradiated pattern was straight lines of 240 μm with a distance of 400 μm between the lines.

After irradiation were the samples washed in deionized water (DIW). In the next step were the samples activated in a commercial solution containing palladium(II) ions. The palladium ions were reduced to palladium metal by dipping the panel in a commercial reducing media. The panels were then washed in DIW before placing them in a commercial chemical copper bath for copper plating.

The results on the panels were straight lines of copper with a line width between 235 to 245 μm and a distance of 400 μm between the copper lines with film thickness of 6 to 8 μm.

Example 2

A grafting solution consisting of acrylic acid (10 weight-%), 2,4,6-trimethylbenzoyl-diphenylphosphine oxide (0.8 weight-%) and ethanol was prepared.

The solution was sprayed by an air spray gun to a panel made of PA 6 polymer filled with carbon black and glass fiber (50 wt %) of 8×8 cm size. The dry thickness was varied from 10 μm to 50 μm. Drying time (sample could be handle without damaging the dry grafting layer) varied from 10 seconds to 40 seconds at room temperature dependent on wet film thickness.

The panels were irradiated with a 2W laser emitting light at 355 nm.

The samples were irradiated with an energy of 900 mJ/cm$^2$. The spot diameter was 120 μm. The irradiated pattern was straight lines of 180 μm with a distance of 400 μm between the lines.

After irradiation were the samples washed in deionized water (DIW). In the next step were the samples activated in a commercial solution containing palladium(II) ions. The palladium ions were reduced to palladium metal by dipping the panel in a commercial reducing media. The panels were then washed in DIW before placing them in a commercial chemical copper bath for copper plating.

The results on the panels were straight lines of copper with a line width between 178 to 182 μm and a distance of 400 μm between the copper lines with film thickness of 0.8 to 1.2 μm.

Example 3

After different times—laser irradiation, multiple scanning A grafting solution consisting of methacrylic acid (2 weight-%), [1-(4-phenylsulfanylbenzoyl)heptylideneamino]benzoate (0.15 weight-%) and ethanol was prepared.

The solution was sprayed by an air spray gun to a panel made of PA 6/PA 66 polymer filled with carbon black and glass fiber (50 weight-%) of 8×8 cm size. The dry thickness was varied from 10 μm to 50 μm. Drying time (sample could be handle without damaging the dry grafting layer) varied from 10 seconds to 40 seconds at room temperature dependent on wet film thickness.

The panels were irradiated with a 4W laser emitting light at 355 nm.

The samples were irradiated with different energy dependent on laser speed and number of repetition. The spot diameter was 120 μm. The irradiated pattern was straight lines of 180 μm with a distance of 400 μm between the lines.

After irradiation were the samples washed in deionized water (DIW). In the next step were the samples activated in a commercial solution containing palladium(II) ions. The palladium ions were reduced to palladium metal by dipping the panel in a commercial reducing media. The panels were then washed in DIW before placing them in a commercial chemical copper bath for copper plating.

The results on the panels were straight lines of copper with a line width between 178 to 182 μm and a distance of 200 μm between the copper lines.

| Laser scan speed (every pulse 16 ps, 1 repetition) (m/s) | Defined pattern with high resolution | Film thickness (μm) |
|---|---|---|
| 4 | Yes | 1.1-1.3 |
| 8 | Yes | 1.1-1.3 |
| 12 | Yes | 1.2-1.4 |
| 20 | Yes | 1.0-1.2 |

| Number of repetition of the laser ray (every pulse 16 ps, laser scan speed 4 m/s) (m/s) | Defined pattern with high resolution | Film thickness (μm) |
|---|---|---|
| 2 | Yes | 1.2-1.4 |
| 4 | Yes | 1.1-1.3 |
| 8 | Yes | 1.0-1.2 |
| 16 | Yes | 1.1-1.3 |

| Irradiation energy (mJ/cm$^2$) | Defined pattern with high resolution | Film thickness (μm) |
|---|---|---|
| 200 | Yes. with some small distortion | 1.0-1.2 |
| 400 | Yes | 1.1-1.3 |
| 800 | Yes | 1.1-1.3 |
| 2000 | Yes | 1.2-1.4 |

Example 4

A grafting solution consisting of acrylic acid (5.0 wt %), dicumyl peroxide (0.08 wt %) and ethanol was prepared.

Five PA6 panel 5 cm×10 cm was dipped into the grafting solution.

The panels were placed in an oven at 75° C. for 20 minutes.

After heat curing were the samples washed in deionized water (DIW). In the next step were the samples activated in a commercial solution comprising palladium (II) ions. The palladium ions were reduced to palladium metal by dipping the panel in a commercial reducing media. The panels were then washed in DIW before placing them in a commercial chemical copper bath for copper plating.

A full coverage of copper was obtained and the panel showed excellent adhesion in testing >24 N/cm (according to ASTM B533).

Example 5

A grafting solution consisting of methacrylic acid (40 wt %), 2,2-azo di(isobutyronitrile) (AIBN) (1.2 wt %) and methanol/ethanol (1:1) was prepared.

The solution was sprayed by an air spray gun to ten PA6 panels 5 cm×10 cm.

The panels were placed in an oven at 75° C. for 25 minutes.

After reactions in the oven were the samples washed in deionized water (DIW). In the next step were the samples activated in a commercial solution comprising palladium(II) ions. The palladium ions were reduced to palladium metal by dipping the panel in a commercial reducing media. The panels were then washed in DIW before placing them in a commercial chemical copper bath for copper plating.

A full coverage of copper was obtained and the panels showed excellent performance in adhesion testing, >24 N/cm (according to ASTM B533).

Example 6

A grafting solution consisting of acrylic acid (5.0 wt %), dicumyl peroxide (0.08 wt %), 2,4,6-trimethylbenzoyl-diphenylphosphine oxide (0.05 wt %) and ethanol was prepared.

Ten PA6 panel 5 cm×10 cm was dipped into the grafting solution.

The panels were first placed in an oven at 75° C. for 5 minutes and then the panels were irradiated with a 200 W mercury Fusion system lamp.

The samples were irradiated with an energy of 600 mJ/cm$^2$.

After heat and UV irradiation were the samples washed in deionized water (DIW). In the next step were the samples activated in a commercial solution comprising palladium (II) ions. The palladium ions were reduced to palladium metal by dipping the panel in a commercial reducing media. The panels were then washed in DIW before placing them in a commercial chemical copper bath for copper plating.

A full coverage of copper was obtained and the panel showed excellent adhesion in testing >18 N/cm (according to ASTM B533).

Example 7

A grafting solution consisting of methacrylic acid (8.0 wt %), dicumyl peroxide (0.1 wt %), 2,4,6-trimethylbenzoyl-diphenylphosphine oxide (0.08 wt %) and a 1:1 mixture of 2-propanol/ethanol was prepared.

5 PA6 panels with 30% Glasfibre, 5 cm×10 cm was sprayed with the grafting solution.

The panels were first irradiated with a 200 W mercury Fusion system lamp and then placed on an IR lamp conveyor where the peak temperature on the panel is 80° C. for 4 minutes.

The samples were in the UV region irradiated with an energy of 500 mJ/cm$^2$. The full spectrum from UV at 300 nm to through visible into IR was utilized during curing.

The network formed was relaxed and hade low internal stress due to the dual curing mechanism. This is shown in the average adhesion value. Comparison with only UV gave 23% lower adhesion and only IR on the grafting solution gave 28% lower adhesion value compared to the dual grafting mechanism.

After UV and IR irradiation were the samples washed in deionized water (DIW). In the next step were the samples activated in a commercial solution comprising palladium (II) ions. The palladium ions were reduced to palladium metal by dipping the panel in a commercial reducing media. The panels were then washed in DIW before placing them in a commercial chemical copper bath for copper plating.

A full coverage of copper was obtained and the panel showed excellent adhesion in testing >23 N/cm (according to ASTM B533).

Example 8

A grafting solution consisting of acrylic acid (7.0 wt %), polyester oligomer (3.0 wt-%, 6 functional of acrylic unsaturation, Molecular weight approx. 1200), dicumyl peroxide (0.12 wt %), 9-Fluorenone (0.09 wt %) and a 1:3 mixture of 2-propanol/ethanol was prepared.

Five PA6 panels, 5 cm×10 cm was sprayed with the grafting solution 2 times and water rinsing in between.

The panels were first irradiated with a 200 W mercury Fusion system lamp and then placed on an IR lamp conveyor where the peak temperature on the panel is 80° C. for 4 minutes.

The samples were in the UV region irradiated with an energy of 500 mJ/cm$^2$. The full spectrum from UV at 300 nm to through visible into IR was utilized during curing.

The network formed was relaxed and hade low internal stress due to the dual curing mechanism. This is shown in the average adhesion value. Comparison with only UV on the grafting solution gave 24% lower adhesion value and only IR gave 29% lower adhesion compared to the dual grafting mechanism.

After UV and IR irradiation were the samples washed in deionized water (DIW). In the next step were the samples activated in a commercial solution comprising palladium (II) ions. The palladium ions were reduced to palladium metal by dipping the panel in a commercial reducing media. The panels were then washed in DIW before placing them in a commercial chemical copper bath for copper plating.

A full coverage of copper was obtained and the panel showed excellent adhesion in testing >19 N/cm (according to ASTM B533).

Example 9

A grafting solution consisting of acrylic acid (9.0 wt %), 1.0% ethylacrylate, dicumyl peroxide (0.095 wt %), isopropyl thioxantone (0.08 wt %) and ethanol was prepared.

8 PA6 panels with 30% Glasfibre, 5 cm×10 cm was sprayed with the grafting solution.

The panels were first irradiated with a 200 W mercury Fusion system lamp and then placed on an IR lamp conveyor where the peak temperature on the panel is 80° C. for 4 minutes.

The samples were in the UV region irradiated with an energy of 450 mJ/cm$^2$. The full spectrum from UV at 300 nm to through visible into IR was utilized during curing.

The network formed was relaxed and hade low internal stress due to the dual curing mechanism. This is shown in the average adhesion value. Comparison with only UV gave 22% lower adhesion and only IR on the grafting solution gave 31% lower adhesion value compared to the dual grafting mechanism.

After UV and IR irradiation were the samples washed in deionized water (DIW). In the next step were the samples activated in a commercial solution comprising palladium (II) ions. The palladium ions were reduced to palladium metal by dipping the panel in a commercial reducing media. The panels were then washed in DIW before placing them in a commercial chemical copper bath for copper plating.

A full coverage of copper was obtained and the panel showed excellent adhesion in testing >23 N/cm (according to ASTM B533).

Example 10

A grafting solution consisting of acrylic acid (9.0 wt %), 1.0% ethylacrylate, dicumyl peroxide (0.095 wt %), isopropyl thioxantone (0.08 wt %) and ethanol was prepared.

10 PA6 panels with 30% Glasfibre, 5 cm×10 cm was sprayed with the grafting solution.

The panels were first placed on an IR lamp conveyor where the peak temperature on the panel is 80° C. for 5 minutes and then irradiated with a 200 W mercury Fusion system lamp.

The samples were in the UV region irradiated with an energy of 550 mJ/cm$^2$. The full spectrum from UV at 300 nm to through visible into IR was utilized during curing.

The network formed was relaxed and hade low internal stress due to the dual curing mechanism. This is shown in the average adhesion value. Comparison with only IR gave 26% lower adhesion and only UV on the grafting solution gave 17% lower adhesion value compared to the dual grafting mechanism.

After IR and UV irradiation were the samples washed in deionized water (DIW). In the next step were the samples activated in a commercial solution comprising palladium (II) ions. The palladium ions were reduced to palladium metal by dipping the panel in a commercial reducing media. The panels were then washed in DIW before placing them in a commercial chemical copper bath for copper plating.

A full coverage of copper was obtained and the panel showed excellent adhesion in testing >23 N/cm (according to ASTM B533).

We claim:

1. A method for application of a metal on a substrate, said method comprising the steps of:

a) providing a substrate, wherein at least a part of the surface of the substrate comprises at least one selected from the group consisting of an abstractable hydrogen atom and an unsaturation, b) contacting at least a part of the surface of the substrate with at least one polymerizable unit, a single initiator compound, and optionally at least one solvent, wherein said at least one polymerizable unit is able to undergo a chemical reaction to form a polymer comprising at least one charged group, wherein said single initiator compound consists of a compound which has the ability to be activated by both heat and actinic radiation and which is selected from the group consisting of alpha-hydroxyketones, phenylglycolates, acylphospine oxides, alpha aminoketones, benzildimethylketals and oxime esters, c) inducing a polymerization reaction initiated only by the single initiator compound as initiator by exposure of the single initiator compound to both heat and actinic radiation adapted to said single initiator compound to form polymers on at least a part of the surface of said substrate, wherein the energy of said actinic radiation is in a range of from 50 to 900 mJ/cm$^2$, said polymers comprising at least one charged group, and said polymers forming covalent bonds after reaction with at least one selected from an abstractable hydrogen atom and an unsaturation on said substrate, and d) depositing a second metal on an already applied first metal on said polymers to obtain a metal coating, wherein at least one of the following additions is made to provide the first metal at least once at a point selected from: before step b), between steps b) and c), and between steps c) and d):

i) addition of ions of at least one first metal and reducing said ions to metal, wherein a) said ions have the opposite sign of the charge compared to said at least one charged group on said polymer, or b) wherein said ions have the same sign of the charge compared to said at least one charged group on said polymer and wherein at least one chemical compound is added and at least partly adsorbed to the polymer comprising at least one charged group, said at least one chemical compound comprising at least one charge with a sign opposite compared to said ions, and ii) addition of metal particles of at least one first metal, wherein said particles have a diameter in the range 1-1000 nm.

2. The method according to claim 1, wherein further metal is applied to the second metal on the surface of the substrate, said further metal is selected from the group consisting of the said second metal and a third metal.

3. The method according to claim 1, wherein the substrate comprises at least one polymer.

4. The method according to claim 1, wherein said single initiator compound forms one phase together with said at least one polymerizable unit and said optional at least one solvent.

5. The method according to claim 1, wherein said polymerization reaction is induced by heat and UV-light adapted to said single initiator compound.

6. The method according to claim 1, wherein a solvent is present and the solvent is at least one selected from the group consisting of methanol, ethanol, acetone, ethylene glycol, isopropyl alcohol, and ethyl acetate.

7. The method according to claim 1, wherein a solvent is present and the solvent is at least one selected from the group consisting of methanol, and ethanol.

8. The method according to claim 1, wherein the at least one polymerizable unit is at least one organic acid.

9. The method according to claim 1, wherein the at least one polymerizable unit is at least one selected from the group consisting of methacrylic acid, acrylic acid, and maleic acid.

10. The method according to claim 1, wherein the at least one polymerizable unit is at least one selected from the group consisting of methacrylic acid, ethyl acrylate, 2-hydroxyethyl acrylate and acrylic acid.

11. The method according to claim 1, wherein the substrate is treated with at least one selected from the group consisting of plasma, corona, and flame treatment before step b).

12. The method according to claim 1, wherein the substrate is washed before step d).

13. The method according to claim 1, wherein the first metal is palladium.

14. The method according to claim 1, wherein the second metal is at least one selected from the group consisting of copper, silver, nickel and gold.

15. The method according to claim 1, wherein at least one solvent is present in step b) and wherein said at least one solvent is at least partially evaporated between step b) and step c).

16. The method according to claim 1, wherein the at least one polymerizable unit is at least one selected from a polymerizable monomer and a polymerizable oligomer.

17. The method according to claim 1, wherein the polymerization is induced by exposure to heat adapted to said single initiator compound and subsequently exposure to actinic radiation adapted to said single initiator compound.

18. The method according to claim 1, wherein the polymerization is induced by exposure to actinic radiation adapted to said single initiator compound and subsequently exposure to heat adapted to said single initiator compound.

19. The method according to claim 1, wherein the polymerization is induced by exposure to actinic radiation adapted to said single initiator compound and exposure to heat adapted to said single initiator compound, simultaneously.

20. The method according to claim 1, wherein the single initiator compound which has the ability to be activated by both heat and actinic radiation is selected from the group consisting of 1-hydroxy-cyclohexyl-phenyl-ketone, 2-hydroxy-2-methyl-1-phenyl-1-propanone, 2-hydroxy-1-{4-[4-(2-hydroxy-2-methyl-propionyl)-benzyl]-phenyl}-2-methylpropan-1-one, and 2-hydroxy-1-[4-(2-hydroxyethoxy) phenyl]-2-methyl-1-propanone.

21. The method according to claim 1, wherein the single initiator compound which has the ability to be activated by both heat and actinic radiation is selected from the group consisting of oxy-phenyl-acetic acid 2-[2-oxo-2-phenyl-acetoxy-ethoxy]-ethyl ester, oxy-phenyl-acetic acid 2-[2-hydroxy-ethoxy]-ethyl ester, and phenyl glyoxylic acid methyl ester.

22. The method according to claim 1, wherein the single initiator compound which has the ability to be activated by both heat and actinic radiation is selected from the group consisting of 2,4,6-trimethylbenzoyl-diphenylphosphine oxide, 2,4,6-trimethylbenzoyl-diphenyl phosphinate, and bis (2,4,6-trimethylbenzoyl)-phenylphosphineoxide.

23. The method according to claim 1, wherein the single initiator compound which has the ability to be activated by both heat and actinic radiation is selected from the group consisting of 2-methyl-1 [4-(methylthio)phenyl]-2-morpholinopropan-1-one, 2-benzyl-2-dimethylamino-1-(4-morpholinophenyl)-butanone-1, and 2-dimethylamino-2-(4-methyl-benzyl)-1-(4-morpholin-4-yl-phenyl)-butan-1-one.

24. The method according to claim 1, wherein the single initiator compound which has the ability to be activated by both heat and actinic radiation is 2,2-dimethoxy-1,2-diphenylethan-1-one.

25. The method according to claim 1, wherein the single initiator compound which has the ability to be activated by both heat and actinic radiation is selected from the group consisting of [1-(4-phenylsulfanylbenzoyl)heptylideneamino]benzoate, and [1-[9-ethyl-6-(2-methylbenzoyl)carbazol-3-yl]ethylideneamino] acetate.

26. The method according to claim 1, wherein the energy of said actinic radiation is in a range of from 50 to 800 $mJ/cm^2$.

27. The method according to claim 1, wherein the energy of said actinic radiation is in a range of from 50 to 600 $mJ/cm^2$.

28. A method for application of a metal on a substrate, said method comprising the steps of:

a) providing a substrate, wherein at least a part of the surface of the substrate comprises at least one selected from the group consisting of an abstractable hydrogen atom and an unsaturation, b) contacting at least a part of the surface of the substrate with at least one polymerizable unit, at least one initiator, and optionally at least one solvent, wherein said at least one polymerizable unit is able to undergo a chemical reaction to form a polymer comprising at least one charged group, wherein said at least one initiator comprises at least one compound which has the ability to be activated by both heat and actinic radiation and which is selected from the group consisting of [1-(4-phenylsulfanylbenzoyl)heptylideneamino] benzoate, and [1-[9-ethyl-6-(2-methylbenzoyl)carbazol-3-yl]ethylideneamino] acetate, c) inducing a polymerization reaction by exposure to both heat and actinic radiation adapted to said at least one initiator compound to form polymers on at least a part of the surface of said substrate, said polymers comprising at least one charged group, and said polymers forming covalent bonds after reaction with at least one selected from an abstractable hydrogen atom and an unsaturation on said substrate, and d) depositing a second metal on an already applied first metal on said polymers to obtain a metal coating, wherein at least one of the following additions is made to provide the first metal at least once at a point selected from: before step b), between steps b) and c), and between steps c) and d):

i) addition of ions of at least one first metal and reducing said ions to metal, wherein a) said ions have the opposite sign of the charge compared to said at least one charged group on said polymer, orb) wherein said ions have the same sign of the charge compared to said at least one charged group on said polymer and wherein at least one chemical compound is added and at least partly adsorbed to the polymer comprising at least one charged group, said at least one chemical compound comprising at least one charge with a sign opposite compared to said ions, and ii) addition of metal particles of at least one first metal, wherein said particles have a diameter in the range 1-1000 nm.

* * * * *